US012257487B2

(12) United States Patent
Lodge

(10) Patent No.: US 12,257,487 B2
(45) Date of Patent: Mar. 25, 2025

(54) AQUATIC GAME APPARATUS AND METHOD

(71) Applicant: ARION LLC, Scottsdale, AZ (US)

(72) Inventor: Jaron Peter Lodge, Scottsdale, AZ (US)

(73) Assignee: ARION LLC, Scottsdale, AZ (US)

( * ) Notice: Subject to any disclaimer, the term of this patent is extended or adjusted under 35 U.S.C. 154(b) by 985 days.

(21) Appl. No.: 17/006,878

(22) Filed: Aug. 30, 2020

(65) Prior Publication Data

US 2021/0060397 A1 Mar. 4, 2021

Related U.S. Application Data

(60) Provisional application No. 62/893,889, filed on Aug. 30, 2019.

(51) Int. Cl.
*A63B 67/00* (2006.01)
*A63B 67/06* (2006.01)

(52) U.S. Cl.
CPC ..... *A63B 67/007* (2013.01); *A63B 67/06* (2013.01); *A63B 2208/03* (2013.01); *A63B 2209/00* (2013.01); *A63B 2225/605* (2013.01)

(58) Field of Classification Search
CPC ... A63B 67/007; A63B 67/06; A63B 2209/00; A63B 2208/03; A63B 2225/605; A63B 65/10
USPC ..... 273/350
See application file for complete search history.

(56) References Cited

U.S. PATENT DOCUMENTS 715,249 A * 12/1902 Dunbar ..... A63B 67/06 273/401
3,656,749 A * 4/1972 Reyes ..... A63B 63/08 273/350
3,895,801 A * 7/1975 Baird ..... A63B 63/00 273/350
4,212,462 A * 7/1980 Glovak ..... A63B 65/10 473/588
6,905,430 B2 6/2005 Davis
7,464,937 B1 12/2008 Maggio
(Continued)

OTHER PUBLICATIONS

GoPong, GoPong Pool Pong Rack Floating Beer Pong Set, web advertisement, visited Aug. 29, 2020, https://www.amazon.com/GoPong-Pool-Floating-Rafts-Balls/dp/B001NPQ6E0/ref=asc_df_B001NPQ6E0/?tag=hyprod-20&linkCode=df0&hvadid=167134282234&hvpos=202&hvnetw=g&hvrand=14563960882065314381&hvpone=&hvptwo=&hvqmt=&hvdev=c&hvdvcmdl=&hvlocint=&hvlocphy=9030087&hvtargid=pla-171127102372&psc=1.

*Primary Examiner* — Jeffrey S Vanderveen
(74) *Attorney, Agent, or Firm* — The Lisa Foundation Patent Law Clinic; Qiguang (Roger) Pan; Spencer Kirkham

(57) ABSTRACT

An aquatic game apparatus and method. The apparatus comprises a water skipping article, comprising a high-density foam material, a top surface having a rounded side profile, a rounded outer perimeter, and a bottom surface. The top surface of the water skipping article comprises a first elliptically extended face, a second elliptically extended face, and a continuous smooth-edged outer perimeter. The apparatus comprises a target, comprising a pop-up board and at least one of a plurality of fillable weight bags coupled to the pop-up board by at least one of a plurality of straps, wherein the fillable bags are configured to stabilize the target on a water surface. The pop-up board of the target comprises an upper surface having a plurality of pocketed nets, and a
(Continued)

lower surface having a plurality of integrally formed flotation units, wherein the upper surface is elevated above the lower surface by a support pole.

20 Claims, 6 Drawing Sheets

(56) References Cited

U.S. PATENT DOCUMENTS

| | | | | |
|---|---|---|---|---|
| 7,648,421 | B2 * | 1/2010 | Yoon | A63B 63/00 273/400 |
| 8,662,501 | B1 * | 3/2014 | Perales | A63B 67/066 273/400 |
| 9,457,250 | B1 | 10/2016 | Jenkins | |
| 10,065,095 | B2 * | 9/2018 | Gallagher | A63F 9/305 |
| 2006/0247072 | A1 * | 11/2006 | Combs | A63B 63/00 473/348 |
| 2009/0069129 | A1 * | 3/2009 | McCarthy | A63B 24/0021 273/350 |
| 2011/0165978 | A1 * | 7/2011 | Leefeldt | A63B 43/04 473/594 |
| 2018/0001171 | A1 * | 1/2018 | Zavracky | A63B 63/06 |
| 2019/0269993 | A1 * | 9/2019 | Gonzales | A63B 61/00 |
| 2019/0388752 | A1 * | 12/2019 | Crews | A63B 67/06 |
| 2021/0023428 | A1 * | 1/2021 | Falck | A63B 67/007 |

* cited by examiner

AQUATIC GAME APPARATUS AND METHOD

CROSS REFERENCE TO RELATED APPLICATIONS

This application claims the benefit of U.S. Provisional Application No. 62/893,889, filed Aug. 30, 2019.

BACKGROUND

1. Technical Field

Aspects of this document relate generally to systems and methods for an aquatic game.

2. Description of Related Art

Aquatic games rarely withstand active use and are typically made for a more sedate user experience. For example, some aquatic games that emphasize active use lack the support necessary to remain on an aquatic surface, shifting erratically upon user contact. Aquatic games that emphasize support to enable an active user experience typically require cumbersome assembly. Thus, most aquatic games neither emphasize an active user experience nor easy assembly, leaving users with either a staid user experience or a less user-friendly game.

So as to reduce the complexity and length of the Detailed Specification, and to fully establish the state of the art in certain areas of technology, Applicant(s) herein expressly incorporate(s) by reference all of the following materials identified in each numbered paragraph below.

U.S. Pat. No. 6,905,430 discloses a water skipping article comprising a three-dimensional body with an elliptical exterior face and a body exhibiting a smooth and continuous exterior surface further defining a hollowed and interior cavity suspended within said body.

U.S. Pat. No. 9,457,250 discloses a game comprising at least one target, a container housing a board assembly, at least one game piece, a laminated structure including buoyant layers, a target aperture, and a pocket affixed to a bottom of said board assembly and aligned with said target aperture.

U.S. Pat. No. 7,464,937 discloses a water sport target game comprising a float, a plurality of targets, a hook is mounted to the underside of the float, wherein a string is tied at one end to the hook and at the other end of the string is attached a weight.

Applicant(s) believe(s) that the material incorporated above is "non-essential" in accordance with 37 CFR 1.57, because it is referred to for purposes of indicating the background of the invention or illustrating the state of the art. However, if the Examiner believes that any of the above-incorporated material constitutes "essential material" within the meaning of 37 CFR 1.57(c)(1)-(3), Applicant(s) will amend the specification to expressly recite the essential material that is incorporated by reference as allowed by the applicable rules.

SUMMARY

The present disclosure provides among other things an aquatic game apparatus and method. The aquatic game apparatus includes a water skipping article, a target, a pop-up board, and at least one of a plurality of fillable weight bags.

In one embodiment an aquatic game apparatus may comprise a water skipping article comprising a high-density foam material, a top surface having a rounded side profile, a rounded outer perimeter, and a bottom surface. The top surface comprises a first elliptically extended face, a second elliptically extended face, and a continuous smooth-edged outer perimeter. The aquatic game apparatus further comprises a target comprising a pop-up board and at least one of a plurality of fillable weight bags coupled to the pop-up board by at least one of a plurality of straps, wherein the fillable weight bags are configured to stabilize the target on a water surface. The pop-up board comprises an upper surface having a plurality of pocketed nets, and a lower surface having a plurality of integrally formed flotation units, wherein the upper surface is elevated above the lower surface by a support pole.

In some embodiments the support pole may comprise a semi-rigid stanchion, an elastic canvas comprising an upper end coupled to the upper surface of the pop-up board and a lower end coupled to the lower surface of pop-up board, wherein the semi-rigid stanchion is insertably coupled to the elastic canvas at both ends of the elastic canvas.

In some embodiments the plurality of nets may comprise a mesh material. In some embodiments the plurality of integrally formed flotation units may be in a triangular prism configuration. In some embodiments each integrally formed flotation unit may comprise a foam material housed within a waterproof sleeve.

In some embodiments the pop-up board may comprise an integrally-formed wire frame. In some embodiments the wire frame may comprise a semi-rigid material. In some embodiments the wire frame may comprise steel wire.

In some embodiments the bottom surface of the water skipping article may be substantially flat. In some embodiments the water skipping article may comprise a waterproof fabric. In some embodiments, the high-density foam material may be housed within the waterproof fabric. In some embodiments the plurality of straps may be adjustable. In some embodiments the fillable weight bags may comprise a waterproof canvas material.

In some embodiments a method of using an aquatic game apparatus may comprise skipping a water skipping article along a surface of water, the water skipping article comprising a high-density foam material, a top surface having a rounded side profile, a rounded outer perimeter, and a bottom surface. The top surface comprises a first elliptically extended face, a second elliptically extended face, and a continuous smooth-edged outer perimeter.

In some embodiments a method of using an aquatic game apparatus may further comprise contacting a target with the water skipping article, the target comprising a pop-up board and at least one of a plurality of fillable weight bags coupled to the pop-up board by at least one of a plurality of straps, wherein the fillable weight bags are configured to stabilize the target on a water surface. The pop-up board comprises an upper surface having a plurality of pocketed nets, and a lower surface having a plurality of integrally formed flotation units, wherein the upper surface is elevated above the lower surface by a support pole. The support pole may comprise a semi-rigid stanchion, and an elastic canvas comprising an upper end coupled to the upper surface of the pop-up board, and a lower end coupled to the lower surface of the pop-up board, wherein the semi-rigid stanchion is insertably coupled to the elastic canvas at both ends of the elastic canvas.

In some embodiments a method of using an aquatic game apparatus comprises skipping the water skipping article into at least one of the plurality of nets. In some embodiments a method of using an aquatic game apparatus comprises tallying at least one point upon skipping the water skipping article into at least one of the plurality of nets. In some embodiments a method of using an aquatic game apparatus comprises flexing the upper surface of the pop-up board upon contacting the target with the water skipping article.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventor is fully aware that he can be his own lexicographer if desired. The inventor expressly elects, as his own lexicographer, to use only the plain and ordinary meaning of terms in the specification and claims unless he clearly states otherwise and then further, expressly sets forth the "special" definition of that term and explains how it differs from the plain and ordinary meaning. Absent such clear statements of intent to apply a "special" definition, it is the inventor's intent and desire that the simple, plain and ordinary meaning to the terms be applied to the interpretation of the specification and claims.

The inventor is also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventor is fully informed of the standards and application of the special provisions of 35 U.S.C. § 112(f). Thus, the use of the words "function," "means" or "step" in the Detailed Description or Description of the Drawings or claims is not intended to somehow indicate a desire to invoke the special provisions of 35 U.S.C. § 112(f), to define the invention. To the contrary, if the provisions of 35 U.S.C. § 112(f) are sought to be invoked to define the inventions, the claims will specifically and expressly state the exact phrases "means for" or "step for, and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventor not to invoke the provisions of 35 U.S.C. § 112(f). Moreover, even if the provisions of 35 U.S.C. § 112(f) are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

The foregoing and other aspects, features, and advantages will be apparent to those artisans of ordinary skill in the art from the DETAILED DESCRIPTION and DRAWINGS, and from the CLAIMS.

BRIEF DESCRIPTION OF THE SEVERAL VIEWS OF THE DRAWINGS

A more complete understanding of the present invention may be derived by referring to the detailed description when considered in connection with the following illustrative figures. In the figures, like reference numbers refer to like elements or acts throughout the figures.

DETAILED DESCRIPTION

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention. It should be noted that there are many different and alternative configurations, devices and technologies to which the disclosed inventions may be applied. The full scope of the inventions is not limited to the examples that are described below.

In one application, a novel aquatic game apparatus is provided.

Figure 1:
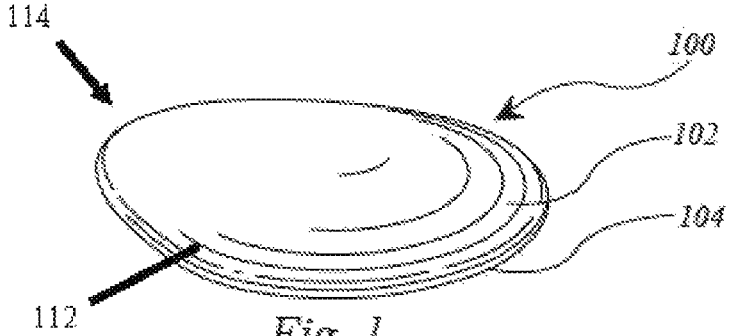
FIG. 1 depicts a perspective view of an implementation of a water skipping article, more specifically a top surface having a rounded side profile.

FIG. 1 illustrates a perspective view of an exemplary implementation of a water skipping article 100. In one non-limiting embodiment, the water skipping article 100 comprises a top surface 102 having a rounded side profile 108. The top surface 102 further comprises a first elliptically extended face 120, a second elliptically extended face 122, and a continuous smooth-edged outer perimeter 112. The water skipping article 100 further comprises a rounded outer perimeter 104 and a bottom surface 106. The water skipping article further comprises a high-density foam material 114. The first 120 and second 122 elliptically extended faces, in conjunction with the rounded side profile 108, rounded outer perimeter 104, and continuous smooth-edged outer perimeter 112, reduce the friction of the water skipping article as it is skipped along a surface of water. This enables the water skipping article 100 to be skipped along a surface of water at an optimal speed and spin, and without stalling upon contact with a water surface. This further enables the water skipping article 100 to form a water wake or ramp, allowing the water skipping article 100 to continue skipping.

Figure 2:
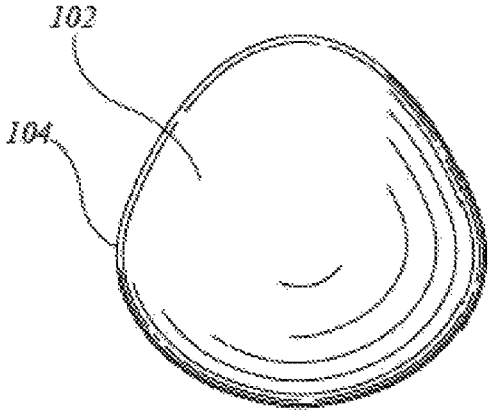
FIG. 2 depicts a top view of an implementation of a water skipping article, more specifically a top surface having a rounded side profile, a rounded outer perimeter, and a continuous smooth-edged outer perimeter.

FIG. 2 illustrates a top view of an implementation of the water skipping article 100, more specifically, the top surface 102 and rounded outer perimeter 104. In some embodiments, the water skipping article 100 comprises a high-density foam material 114. In some embodiments, the water skipping article 100 may comprise a waterproof fabric. In some embodiments, the water skipping article 100 may comprise a waterproof fabric, non-waterproof fabric, plastic, nylon, rubber, canvas material, mesh, or a mixture of any of the preceding materials. In one non-limiting embodiment, the high-density foam material 114 is housed within the waterproof fabric. In some embodiments, the high-density foam material 114 may be housed within a waterproof fabric, non-waterproof fabric, plastic, nylon, rubber, canvas material, mesh, or a mixture of any of the preceding materials. In some embodiments, the water skipping article 100 may be comprised of glow-in-the-dark materials, or be affixed with lighting, to enable gameplay in darkness.

Figure 3:
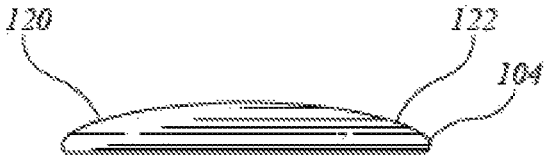
FIG. 3 depicts a rear view of an implementation of a water skipping article, more specifically a top surface having a rounded side profile, a first elliptically extended face, a second elliptically extended face, and a rounded outer perimeter.

FIG. 3 illustrates a rear view of an implementation of the water skipping article 100, more specifically, the first elliptically extended face 120, the second elliptically extended face 122, and the rounded outer perimeter 104.

Figure 4:
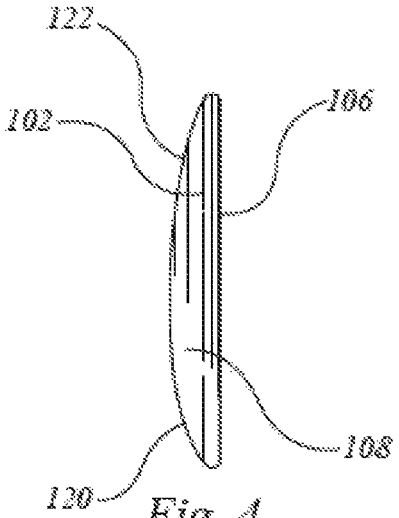
FIG. 4 depicts a left-side view of an implementation of a water skipping article.

FIG. 4 illustrates a left-side view of an implementation of the water skipping article 100, more specifically, the top surface 102 having a rounded side profile 108. The top surface 102 further comprises a first elliptically extended face 120 and a second elliptically extended face 122. As shown in this figure, the water skipping article 100 further comprises the bottom surface 106. In some embodiments, the bottom surface 106 of the water skipping article 100 is substantially flat. In other embodiments, the bottom surface 106 of the water skipping article 100 may be substantially elliptical or substantially round.

Figure 5:
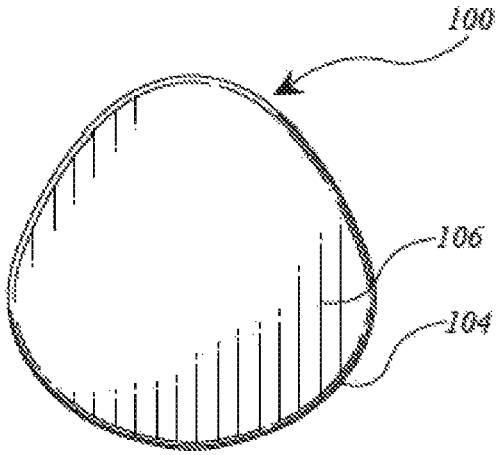
FIG. 5 depicts a bottom view of an implementation of a water skipping article, more specifically a bottom surface.

FIG. 5 illustrates a bottom view of an implementation of the water skipping article 100, more specifically, the bottom surface 106 and rounded outer perimeter 104.

Figure 6:
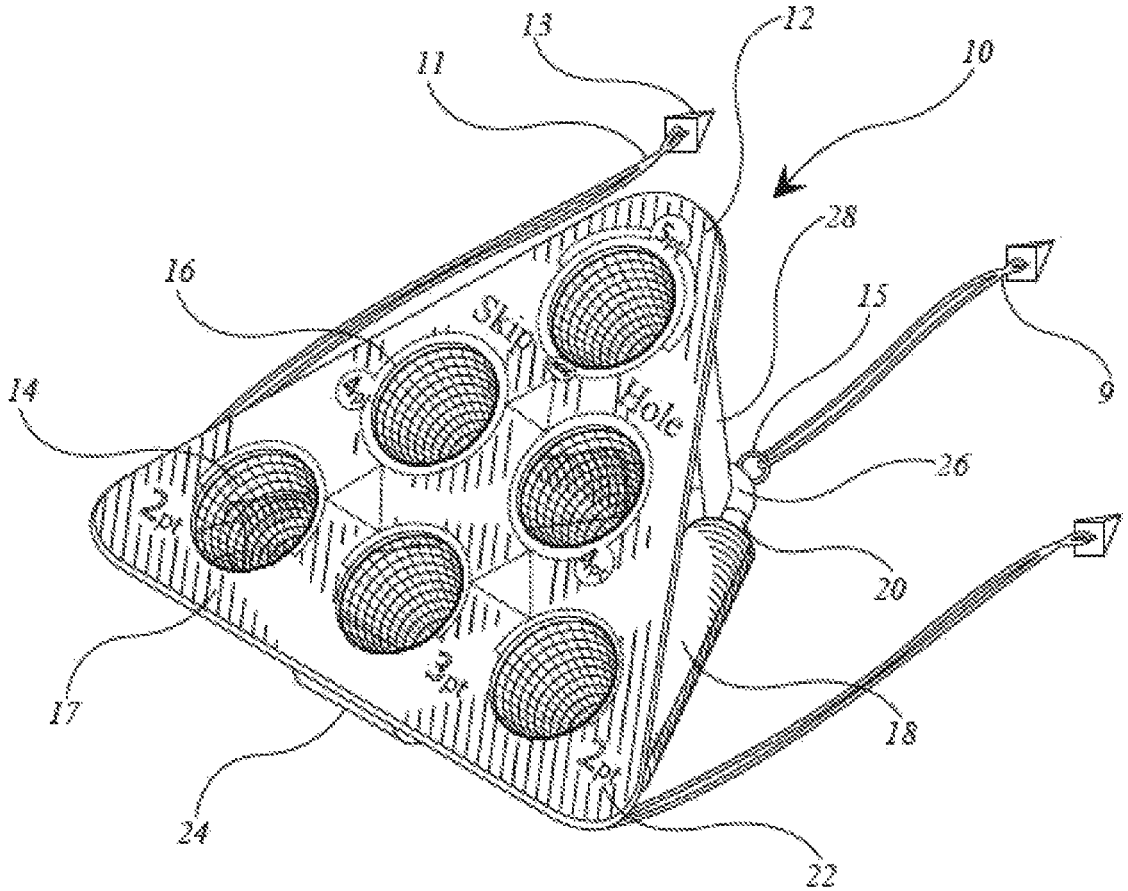
FIG. 6 depicts a perspective view of an implementation of a target, more specifically a pop-up board, an upper surface, a plurality of pocketed nets, a plurality of straps, and a plurality of fillable weight bags.

FIG. 6 illustrates a perspective view of an exemplary implementation of a target 10, more specifically, a pop-up board 12, and at least one of a plurality of fillable weight bags 13 coupled to the pop-up board 12 by at least one of a plurality of straps 11, wherein the fillable weight bags 13 are configured to stabilize the target 10 on a water surface. The pop-up board 12 further comprises an upper surface 17 having a plurality of pocketed nets 14/16, and a lower surface 26 having a plurality of integrally formed flotation units 18/24, wherein the upper surface 17 is elevated above the lower surface 26 by a support pole 28. The upper surface 17 may be shaped as any regular or irregular polygonal figure such as, by nonlimiting example, a triangle, quadrilateral, pentagonal, hexagonal, or octagonal figure. In some embodiments, the upper surface 17 may be shaped as any circle, oval, oblong, or any other closed curve. Similarly, the lower surface 26 may be shaped as any regular or irregular polygonal figure such as, by nonlimiting example, a triangle, quadrilateral, pentagonal, hexagonal, or octagonal figure. In some embodiments, the lower surface 26 may be shaped as any circle, oval, oblong, or any other closed curve. The upper 17 and lower 26 surfaces may be of the same or different shape in relation to one other.

Figure 7:
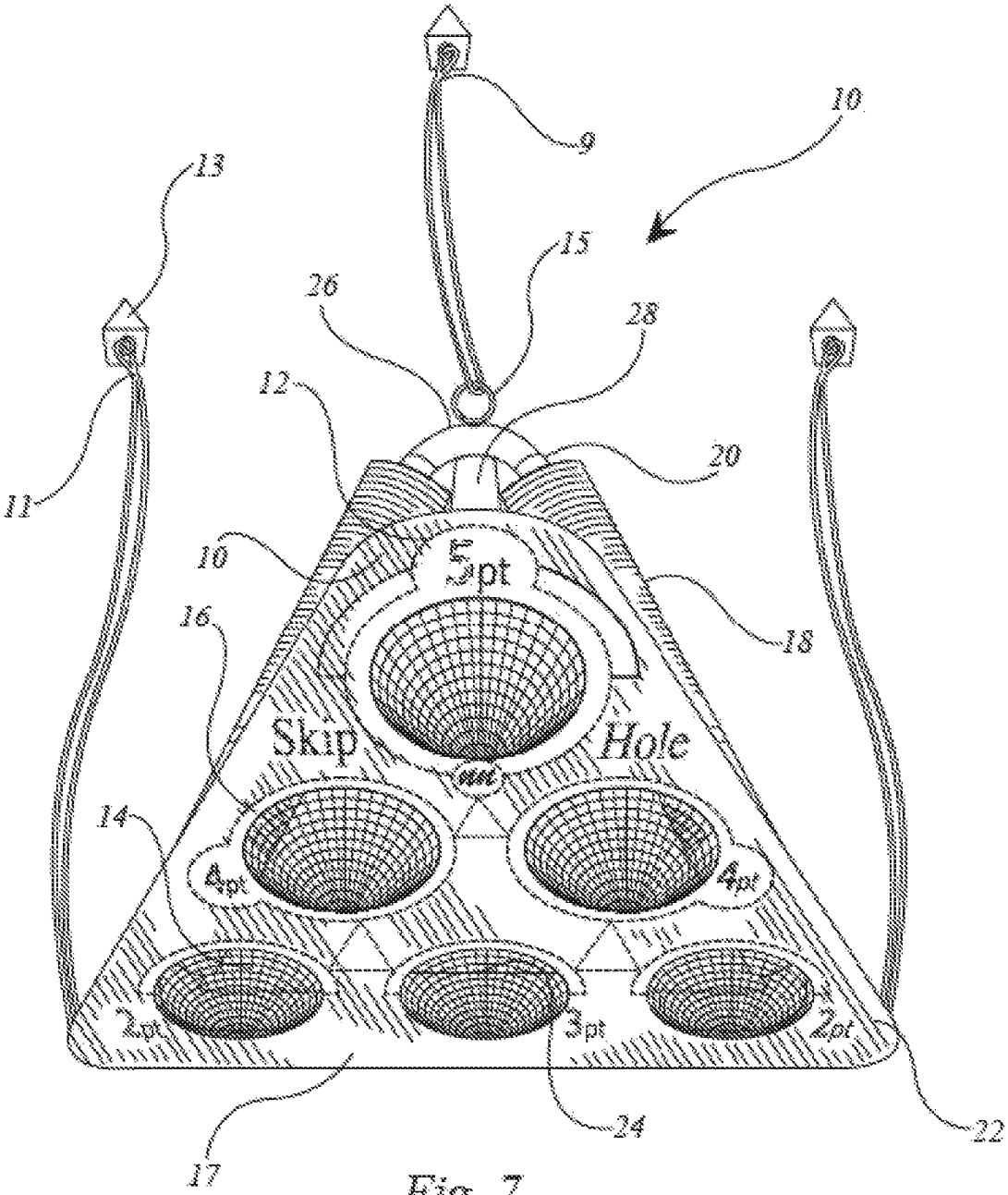
FIG. 7 depicts a top view of an implementation of a target.

FIG. 7 illustrates a top view of an implementation of the target 10, more specifically, the pop-up board 12 and the upper surface 17. In some embodiments, the pop-up board 12 comprises an integrally formed wire frame 22. In some embodiments, the wire frame 22 may be comprised of a semi-rigid material. In one non-limiting embodiment, the wire frame 22 comprises steel wire. In some embodiments, the wire frame 22 may be made of metal, plastic, or any other sufficiently semi-rigid or rigid material that maintains the structural integrity of the pop-up board 12.

In some embodiments, the pop-up board 12 may be comprised of a waterproof canvas material. In other embodiments, the pop-up board 12 may be comprised of a non-waterproof fabric, plastic, nylon, rubber, or tensile fabric. In some embodiments, the upper surface 17 of the pop-up board 12 may be comprised of wood. In some embodiments, the upper 17 and lower 26 surfaces of the pop-up board 12 may be comprised of the same or different material in relation to one another. In some embodiments, the upper surface 17 of the pop-up board 12 may comprise at least one hole without nets. In some embodiments, the target 10 may be comprised of glow-in-the-dark materials, or be affixed with lighting, to enable gameplay in darkness.

Figure 8:
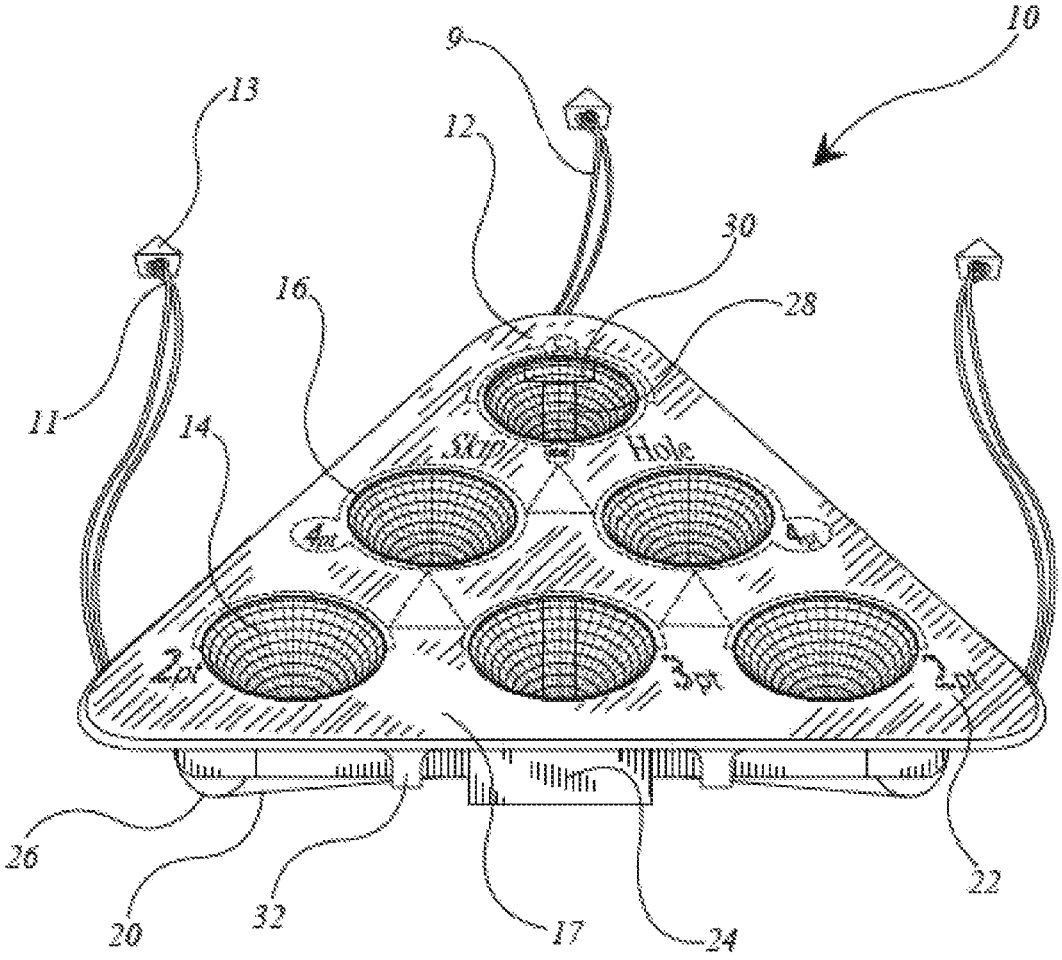
FIG. 8 depicts a front view of an implementation of a target.

FIG. 8 illustrates a front view of an implementation of the target 10, more specifically, the pop-up board 12, the upper surface 17, and the plurality of pocketed nets 14/16. The plurality of pocketed nets 14/16 may comprise, for example, a mesh material. In some embodiments, the plurality of pocketed nets 14/16 may comprise a waterproof fabric, non-waterproof fabric, plastic, nylon, rubber, canvas material, or a mixture of any of the preceding materials. The plurality of pocketed nets 14/16 may be sewn, pinned, stapled, nailed, screwed, or integrally formed into the upper surface 17 of the pop-up board 12. The plurality of pocketed nets 14/16 may be of any diameter and depth suitable for the purpose of receiving the water skipping article 100.

Figure 9:
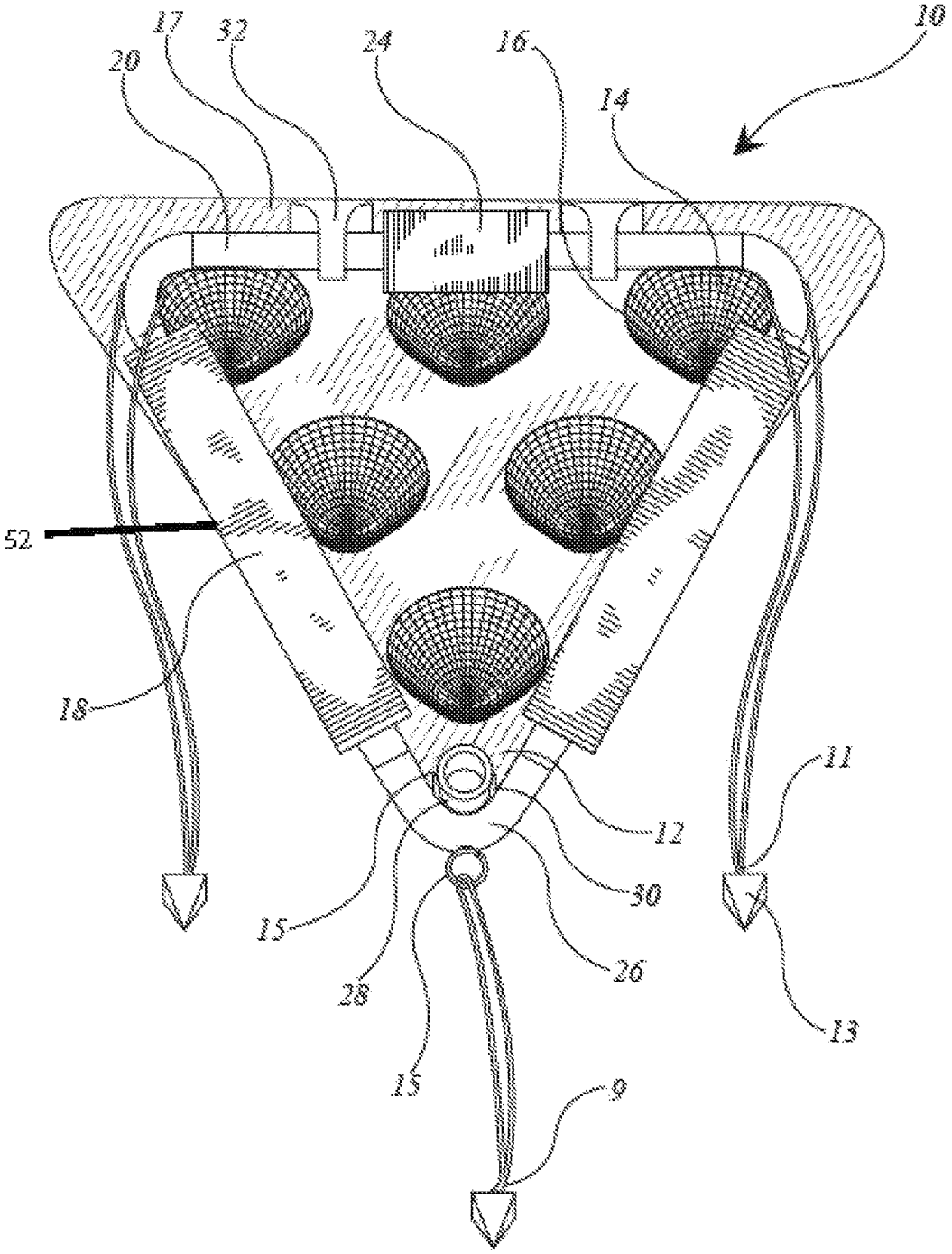
FIG. 9 depicts a bottom view of an implementation of a target, more specifically a pop-up board and a lower surface having a plurality of integrally formed flotation units.

FIG. 9 illustrates a bottom view of an implementation of the target 10, more specifically the pop-up board 12 and the lower surface 26 having the plurality of integrally formed flotation units 18/24. In one non-limiting embodiment, the plurality of integrally formed flotation units 18/24 are in a triangular prism configuration. In some embodiments, the plurality of integrally formed flotation units 18/24 may comprise a foam material housed within a waterproof sleeve 52. In some embodiments, the plurality of integrally formed flotation units 18/24 may comprise any suitably lightweight material enabling the target 10 to remain buoyant on a water surface. In some embodiments, the plurality of integrally formed flotation units 18/24 may be in any regular or irregular polygonal prism configuration such as, by nonlimiting example, a triangle, quadrilateral, pentagonal, hexagonal, or octagonal prism configuration. In some embodiments, the plurality of integrally formed flotation units 18/24 may be in any circle, oval, oblong, or any other closed curve prism configuration.

Figure 10:
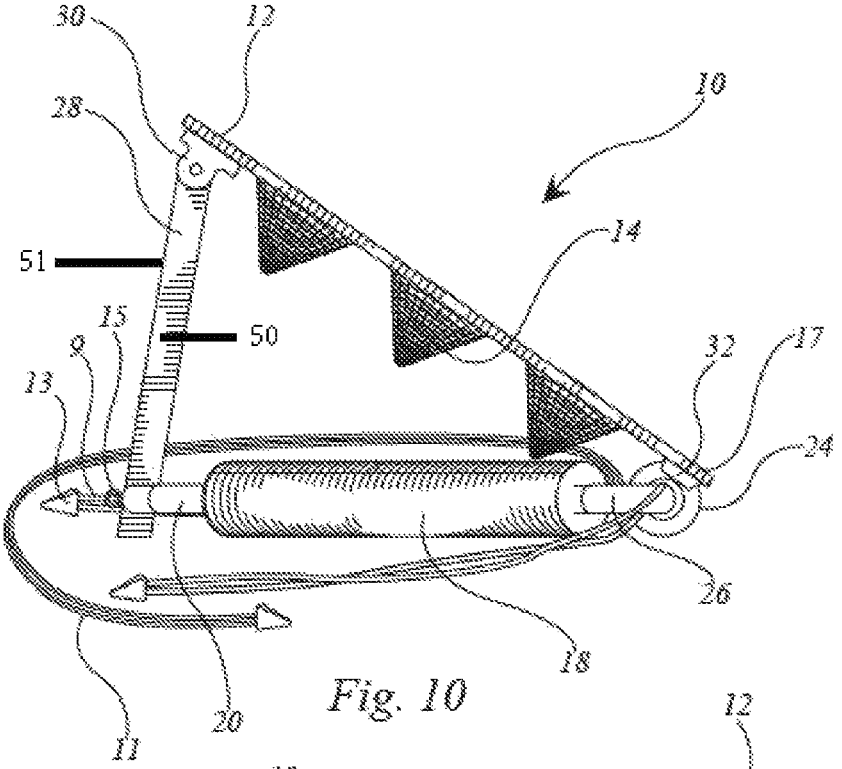
FIG. 10 depicts a left-side view of an implementation of a target, more specifically a pop-up board, an upper surface, a lower surface having a plurality of integrally formed flotation units, and a support pole.

FIG. 10 illustrates a left-side view of an implementation of the target 10, more specifically, the pop-up board 12, the upper surface 17, the lower surface 26 having the plurality of integrally formed flotation units 18/24, and the support pole 28.

In one non-limiting embodiment, the support pole 28 comprises a semi-rigid stanchion 50 and an elastic canvas 51. The elastic canvas 51 further comprises an upper end 30 coupled to the upper surface 17 of the pop-up board 12, and a lower end 15 coupled to the lower surface 26 of the pop-up board 12, wherein the semi-rigid stanchion 50 is insertably coupled to the elastic canvas 51 at both ends 30/15 of the elastic canvas 51. The support pole 28 elevates the upper surface 17 of the pop-up board 12 over the lower surface 26 of the pop-up board 28. Insertably coupling the semi-rigid stanchion 50 to both ends 30/15 of the elastic canvas 51 stretches the elastic canvas 51 from a slacked state to a taut state. The tautness of the elastic canvas 51, in conjunction with the semi-rigid stanchion, ensures the structural integrity of the target while the upper surface 17 is elevated above the lower surface 26. To collapse the pop-up board 12, the semi-rigid stanchion 50 may be removed, slackening the elastic canvas 51 and collapsing the upper surface 17 onto the lower surface 26.

The elastic canvas 51 may comprise a waterproof fabric, non-waterproof fabric, plastic, nylon, rubber, canvas material, tensile fabric, a mixture of any of the preceding materials, or any flexible material suitable for the proper operation of the support pole 28. The semi-rigid stanchion 50 may comprise fiberglass, polyvinyl chloride, plastic, metal, rubber, nylon, twine, a mixture of the preceding materials, or any semi-rigid material suitable for the proper operation of the support pole 28. In some embodiments, the support pole 28 may comprise a rigid stanchion. In other embodiments, the support pole 28 may comprise a semi-rigid stanchion 50 that is substantially more flexible than rigid.

Figure 11:
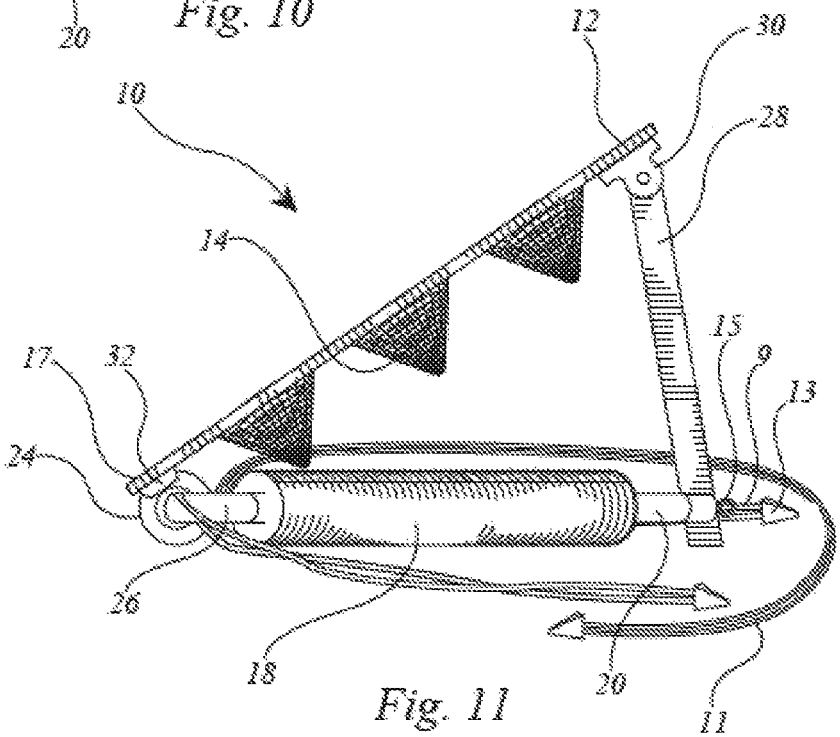
FIG. 11 depicts a right-side view of an implementation of a target, more specifically a pop-up board, an upper surface, a lower surface having a plurality of integrally formed flotation units, and a support pole.

FIG. 11 illustrates a right-side view of an implementation of the target 10, more specifically, the pop-up board 12, and at least one of the plurality of fillable weight bags coupled to the pop-up board 12 by at least one of the plurality of straps 11, wherein the fillable weight bags 13 are configured to stabilize the target 10 on a water surface. In one non-limiting embodiment, the fillable weight bags 13 may comprise a waterproof canvas material. In some embodiments, the fillable weight bags may comprise a waterproof fabric, non-waterproof fabric, plastic, canvas material, or a mixture of any of the preceding materials. In particular, the fillable weight bags 13 stabilize the target 10 on a water surface and help prevent the target 10 from floating away, flipping over, or being tossed aside from the force of wind, water wakes, or the water skipping article 100 upon contact with the water skipping article 100. In some embodiments, the fillable weight bags 13 may be filled with water, rocks, or any other suitable material. In some embodiments, the plurality of straps 11 is adjustable. The plurality of straps 11 allow for the fillable weight bags 13 to be placed at a distance from the pop-up board 12. The plurality of straps 11 may comprise a waterproof fabric, non-waterproof fabric, plastic, nylon, rubber, canvas material, or a mixture of any of the preceding materials.

The aquatic game apparatus, comprising the water skipping article 100 and the target 10, may be used when a user skips the water skipping article 100 along a surface of water towards the target 10 and contacts the target 10 with the water skipping article 100. In some implementations, the user may skip the water skipping article 100 into at least one of the plurality of pocketed nets 14/16. In some implementations, the user may tally at least one point upon skipping the water skipping article 100 into at one of the plurality of pocketed nets 14/16. In some implementations, the upper surface 17 of the pop-up board 12 may flex upon contact of the water skipping article 100 with the target 10.

I claim:

1. An aquatic game apparatus, comprising:

a teardrop-shaped water skipping article, comprising:
- a high density foam material;
- a top surface having a rounded side profile;
- a rounded outer perimeter;
- a bottom surface; and wherein the water skipping article has a non-circular perimeter with a tapering end;

a target configured to float on water, comprising:
- a pop-up board, comprising:
  - an upper surface comprising:
    - a wire frame;
    - a fabric extending within the wire frame; and
    - a plurality of pocketed nets extending from said fabric;
  - wherein the upper surface is triangular shaped and tapers from a connection with the lower surface to said extended end;
  - a lower surface coupled to the upper surface and comprising:
    - a wire frame;
    - wherein wire frame of the lower surface is triangular shaped and wherein the floatation unit extends in a triangular shape;
    - a flotation unit comprising a high density foam material: and
  - wherein the lower surface is triangular shaped and tapers from said connection with the upper surface to an extended end;
  - wherein the upper surface and the lower surface are connected to each other at respective connecting ends and extend to respective extended ends;
  - wherein the upper surface is configured to extend at an angle up from the lower surface, and be retained by a support pole;
  - wherein a support pole is configured between the upper surface and the lower surface:
  - wherein a first pocketed net of the plurality of pocketed nets is configured more proximal to said connection end of the upper surface than a second pocketed net of the plurality of pocketed nets;
  - one or more weight bags, each coupled to the pop-up board by a strap,
  - wherein the weight bags are configured to be placed at a distance from the pop-up board in order to stabilize the target on a water surface;
  - wherein at least one of the one or more weight bags secures the apparatus into a fixed location by anchoring to a point down in the water or to a point above the water surface;
  - wherein at least one of said one or more weight bags is coupled to said strap that extends from a point of the triangular shaped lower surface;
  - wherein each of said straps extends from a point of the triangular shaped lower surface and is coupled to the wire frame; and
  - wherein the pop-up board is configured to be collapsed by bringing the upper surface into contact with the lower surface.

2. The aquatic game apparatus of claim 1, wherein the support pole comprises:

an upper end coupled to the upper surface of the pop-up board; and lower end coupled to the lower surface of the pop-up board.

3. The aquatic game apparatus of claim 1, wherein the plurality of pocketed nets comprise a mesh material.

4. The aquatic game apparatus of claim 1, wherein the lower surface is triangular shaped.

5. The aquatic game apparatus of claim 4, wherein at least one of the said plurality of straps couples to the extended end of the triangular wire frame of the lower surface which are the vertices away from the connection ends of the frame.

6. The aquatic game apparatus of claim 4, wherein at least one of the said plurality of straps couples to at least one of the two tapered ends of the triangular wire frame of the lower surface which are the vertices closer to the connection ends of the frame.

7. The aquatic game apparatus of claim 6, wherein at least one of the said plurality of straps couples to the extended end of the triangular wire frame of the lower surface which are the vertices away from the connection ends of the frame.

8. The aquatic game apparatus of claim 7, wherein the flotation unit comprises said foam material coupled to the outer perimeter of the lower symmetrical frame.

9. The aquatic game apparatus of claim 8, wherein water skipping article is said teardrop-shaped with rounded ends and point and having a first elliptically extended face and a second elliptically extended face that tapers from the first elliptically extended face to said tapered end.

10. The aquatic game apparatus of claim 9, wherein the one or more weight bags comprises two weight bags coupled to the apparatus that secure the apparatus into a fixed location by each anchoring to a point down in the water or to a point above the water surface.

11. The aquatic game apparatus of claim 1, wherein the flotation unit comprises said foam material coupled to the outer perimeter of the lower symmetrical frame.

12. The aquatic game apparatus of claim 1, wherein water skipping article is said teardrop-shaped with rounded ends and point and having a first elliptically extended face and a second elliptically extended face that tapers from the first elliptically extended face to said tapered end.

13. The aquatic game apparatus of claim 1, wherein the weight bags comprise a canvas material.

14. A method of using an aquatic game apparatus, the method comprising:

providing the aquatic game apparatus of claim 1;

floating the pop-up board on a surface of water;

skipping said water skipping article along a said surface of water, contacting the upper surface of the pop-up board with the water skipping article.

15. The method of claim 14 further comprising skipping the water skipping article into at least one of the plurality of pocketed nets.

16. The method of claim 15 further comprising tallying at least one point upon skipping the water skipping article into at least one of the plurality of pocketed nets.

17. The method of claim 14 further comprising flexing the fabric of the upper surface of the pop-up board upon contacting the target with the water skipping article.

18. The method of claim 14, further comprising dropping said weight bags into said water.

19. The method of claim 14, wherein the lower surface is triangular shaped, wherein the lower surface comprises the flotation unit arranged in a triangular shape.

20. The method of claim 19, wherein one of said plurality of weight bags is coupled to said strap that extends from a point of the triangular shaped lower surface.

* * * * *